United States Patent [19]

Aung

[11] 4,408,555

[45] Oct. 11, 1983

[54] SHIPS STEERING GEAR

[76] Inventor: U. Soe Aung, 6A First Mansion, Jalan Daliah, Singapore

[21] Appl. No.: 274,365

[22] Filed: Jun. 16, 1981

[51] Int. Cl.[3] ..... B63H 25/22

[52] U.S. Cl. ..... 114/150; 91/509; 91/510

[58] Field of Search ..... 114/144 R, 150; 91/51, 91/509, 510; 92/134

[56] References Cited

U.S. PATENT DOCUMENTS

| | | | |
|---|---|---|---|
| 3,799,096 | 3/1974 | Jeffery et al. | 114/150 |
| 4,209,986 | 7/1980 | Cunningham | 114/150 |
| 4,296,677 | 10/1981 | Little et al. | 91/510 |

FOREIGN PATENT DOCUMENTS

| | | | |
|---|---|---|---|
| 1174028 | 12/1969 | United Kingdom | 114/150 |

*Primary Examiner*—Trygve M. Blix
*Assistant Examiner*—Thomas J. Brahan
*Attorney, Agent, or Firm*—Emory L. Groff, Jr.

[57] ABSTRACT

In a pressurized-fluid operated steering gear system for a ship of the kind in which a plurality of actuators (piston-and-cylinder or rotary vane) are disposed in opposed pairs to turn the tiller arm when a diametrically opposed pair is pressurized and the other diametrically opposed pair is relieved of pressure the improvement that there is located in the cylinder, or arcuate chamber, of each actuator a free moving member which separates two distinct pressurized fluid inlets of said cylinder or chamber. If there is no pressure delivery from one inlet the member moves to one end of the cylinder or chamber so that the actuator is worked by pressure solely from the other inlet.

8 Claims, 10 Drawing Figures

SHIPS STEERING GEAR

BACKGROUND OF THE INVENTION

1. Field of the Invention

This invention relates to a pressurised-fluid steering gear for a large ship.

In recent years there has been an increasing recognition of the need for a more reliable steering gear for large ships, which has been underlined by at least one disaster to a supertanker attributable to a failure of its steering and is recognised by Protocols and Regulations made under the International Convention for the Safety of Life at Sea, calling as recently as 1980 for improvements in the safety and performance of the hydraulic steering systems of tankers in excess of 10,000 tons displacement and for all other types of ships.

2. Description of the Prior Art

In the known system illustrated in FIG. 1 of the accompanying drawings four hydraulic rams 4C,4D,4E and 4F rotate a rudder stock 1 to any desired position by moving a tiller arm 2 using a mechanism known as a Rapsons slide or variations of this mechanism. The hydraulic power is supplied by two hydraulic pumps 5A and 5B usually known as Helleshaw or Janney pumps, which have variable rate of flow and direction of flow and are driven by electric motors 5A' and 5B'. The direction and rate of oil flow is controlled by the position of a control rod 13 which is attached to the middle of a free-floating lever 12 known a a "hunting lever." One end of this lever is attached to a remote control piston 11 which is operated from the navigation bridge of the ship by remote control means (not shown). The other end of the lever 12 is attached through a link 12' to a point 12'' on the radius of the rudder stock 1.

If the remote control lever 11 is moved to the right as viewed in FIG. 1, this will result in the lever 12 pivoting about its lower end and cause movement of the pump control rod 13 to the right also. This will start oil flow from the cylinders of rams 4C and 4F and into the cylinders 4D and 4E and result in anti-clockwise rotation of the rudder. This will cause the lower end of lever 12 attached to the rudder stock to move to the left. This movement results in lever 12 returning to its mid position and control rod 13 moving left until it reaches its original neutral position. Oil flow then ceases and rudder movement stops. It can thus be seen that the angle taken up by the rudder is directly dependent on the position and movement of remote control piston 11. In case of failure of the remote control system, a local hand steering system 10 may be connected up and used.

Other equipment in the system includes:

(a) Oil feed pumps 6A an 6B which are driven by the same electric motors driving the hydraulic pumps 5A and 5B and supply low pressure oil under constant pressure through non-return feed check valves 14 to both hydraulic systems thus ensuring that the oil is under a minimum pressure and topping up any oil lost from leakage.

(b) Automatic isolating valves 5C and 5D which function to shut off and isolate one hydraulic pump when not in use and prevent back flow of oil between a working pump and an idle pump.

(c) Manual isolating valves 8 serving to shut off two rams out of the four should this become necessary due to partial failure of the hydraulic or mechanical system.

(d) Relief valves 7F which allow excess oil delivered from feed pumps 6 to flow back to an oil storage tank and keep the system under pressure, and (e) Relief valves 7C which will allow exchange of oil between the cylinders in case of high abnormal pressure which may result from action of rough seas on the rudder or by collision of the rudder with an external object.

It may be seen that should such a movement occur, this will cause movement of the rudder stock 1 and the lower point of lever 12 will be displaced. This causes the rod 13 to be displaced resulting in oil flow which will restore the rudder to its former position.

When both hydraulic pumps 5A and 5B are in operation, the rate of oil flow as determined by the position of the pump control rod 13 is double that when only one of the pumps 5A or 5B is in operation. This results in a quicker movement of the rudder with two pumps in use and is normally the case when the ship is manoeuvering in close waters such as when entering or leaving harbour. In the open sea quick rudder movements are not necessary and one pump is shut off.

SUMMARY OF THE INVENTION

The above is a description of an hydraulic steering gear as currently in use. The weakness of this system, having only the features so far described, lies in the face that there is only one common hydraulic system and should major failure of this system occur—such as failure of a major hydraulic pipe coupling—the ship will be left without means of working the rudder which can be brought quickly into use.

A principal object of the invention is to provide a steering gear for a large ship having improved safety factors and moreover one which may be incorporated with the minimum of modification in an existing ship using almost all of the conventional equipment above described so that adaptation of existing systems can be carried out with the minimum of expense as well as the provision of new systems.

In accordance with the invention there is provided in a pressurised-fluid operated steering gear system for a ship, said system comprising four pressurised-fluid actuators disposed in opposed pairs to control a common tiller arm, and two pumps adapted selectively to supply pressurised fluid to actuators which are diametrically opposite across the rotary axis of the tiller arm while fluid is vented from the other two actuators, each said actuator comprising a chamber and means defining opposite end walls of the chamber relatively movable in response to variations of fluid pressure in the chamber, the improvement that two supply lines for pressurised fluid open into the chamber in spaced relation between said end wall defining means and are respectively connected to the pumps and there is provided to extend across the chamber to be movable therein between said end wall defining means an element intermediate and forming a barrier between said supply line openings, said barrier element being movable toward one of said end wall defining means in response to a pressure difference across said barrier element caused by a reduction of pressure in said one supply line relative to the other, each pump being selectively connectable with one of said diametrically opposite pairs of actuators by a respective pair of said supply lines opening to the associated chamber on a respective side of said barrier element therein.

In one embodiment of the invention each chamber is a cylinder, at least one of said end wall defining means comprising a ram reciprocable in the cylinder in response to a variation of the total fluid pressure in the cylinder and said barrier element comprising a free piston reciprocable in the cylinder toward or away from said ram in response to a pressure difference in the cylinder across said free piston. In this arrangement the other end wall defining means may be a closed end of the cylinder.

Said one end wall defining means may comprise a common ram reciprocable in two cylinders on the same side of said rotary axis.

Valves are preferably provided which are selectively operable to control the supply lines associated with each said pump, each valve being movable between a first position communicating said supply lines with said pump, a second position isolating said supply lines from said pump and venting said supply lines and a third position closing said supply lines, there being associated with each valve a mechanism responsive to the other pump such that said mechanism permits movement of said valve to said third position thereof only when said other pump is inoperative. In this arrangement means is preferably provided automatically to move said valve from said first to said second position thereof in response to cessation of the pump associated with said valve and from said second to said third position thereof in response to cessation of said other pump.

In another embodiment of the invention each chamber is an arcuate chamber of a rotary actuator, and said end wall defining means are respectively a stator vane and a rotor vane of said actuator, said barrier element being a free vane interposed between said rotor and stator vanes.

Each said pressurised fluid supply line is preferably in communication with a reservoir for pressurised fluid adapted to provide the required supplement to the volume of fluid in the other said fluid supply line when said barrier element moves to close said one supply line, and means preferably is provided for maintaining fluid in the reservoir under pressure.

BRIEF DESCRIPTION OF THE DRAWINGS

A more complete understanding of the invention may be obtained from the following detailed description of two embodiments thereof given by way of non-limitative example. In the drawings.

DESCRIPTION OF PREFERRED EMBODIMENTS

Figure 1:
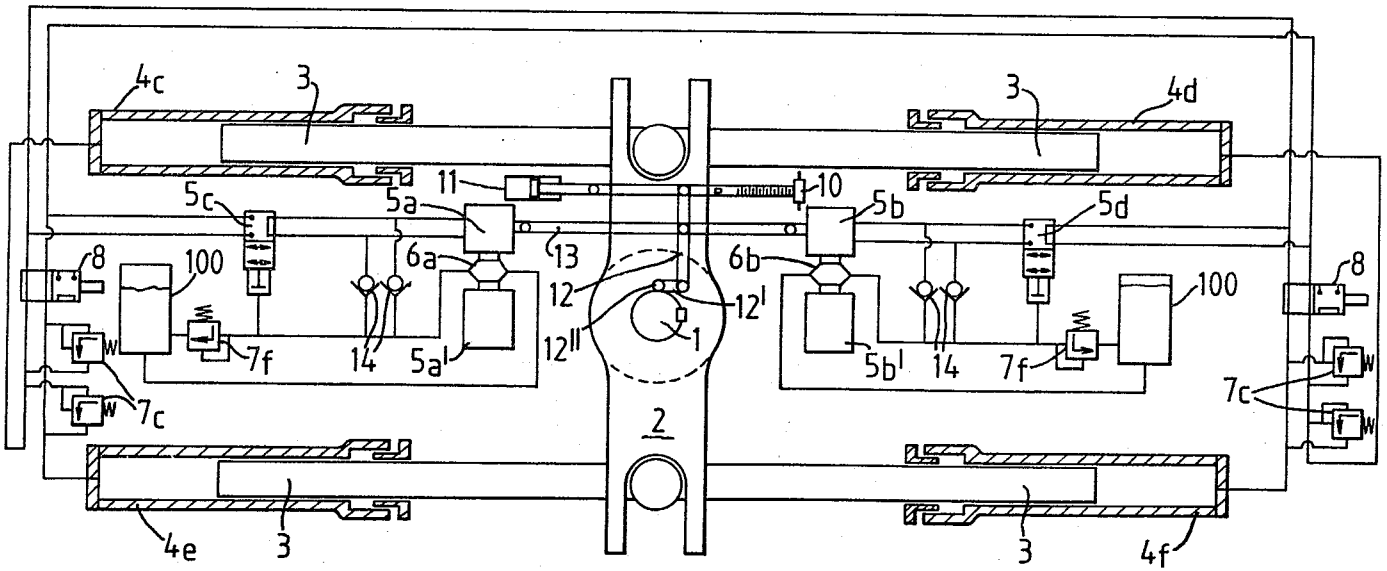
FIG. 1. (PRIOR ART)
FIG. 1 diagrammatically illustrates a ship's hydraulic steering gear of a known kind, as above described, FIG. 2 diagrammatically illustrates modification of the steering gear of FIG. 1 to have features in accordance with the present invention.
Figure 2:
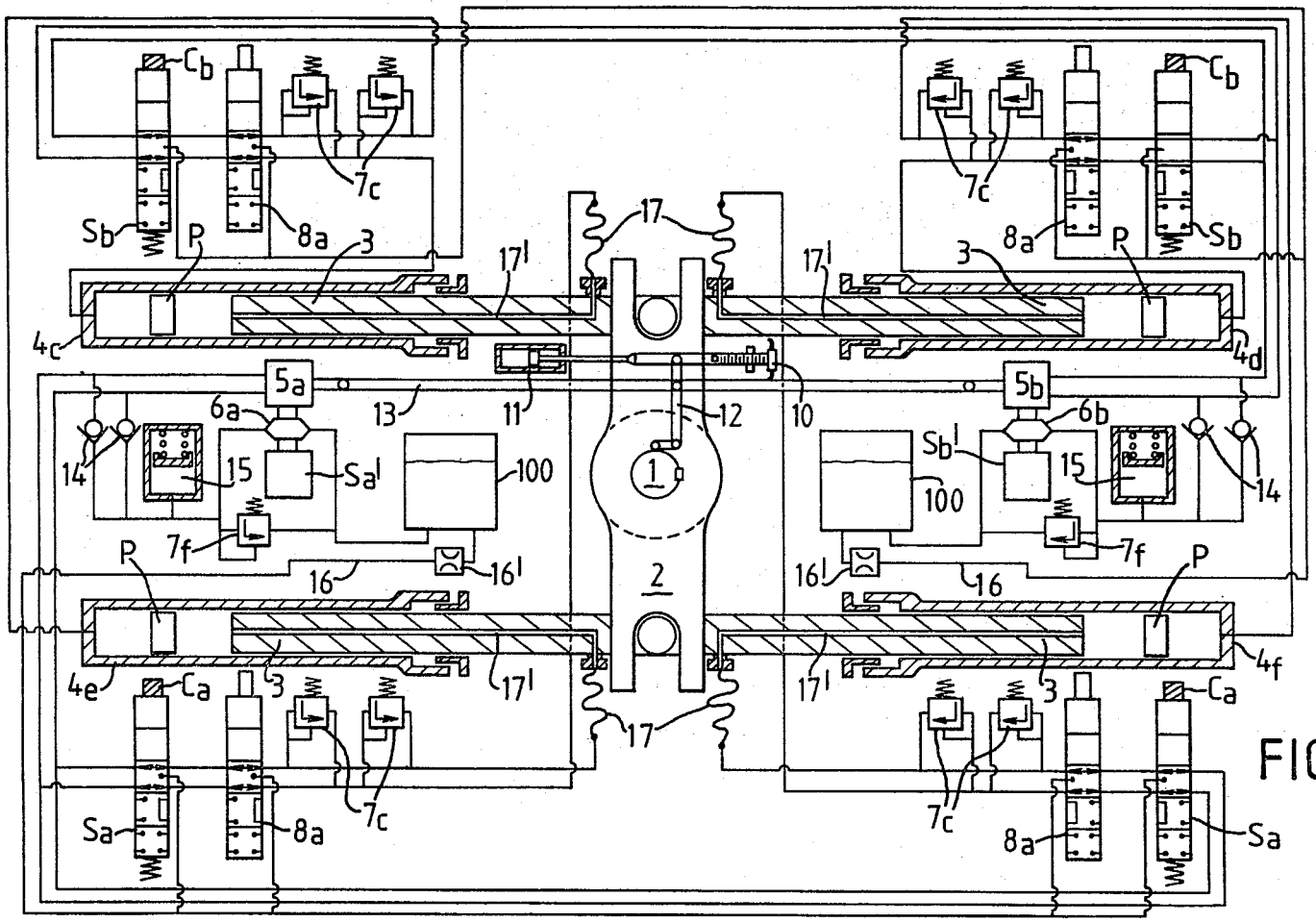

The system of FIG. 1 having been already described, the common details of the system of FIG. 2 will not be repeated, like parts having like reference numerals. The system of FIG. 2 differs in that a free floating piston P is inserted in the cylinder of each hydraulic ram 4. The hydraulic circuit is altered so that two entirely separated supply systems are incorporated, one system connected to one of the hydraulic pumps 5A and the other to 5B. Pump 5B supplies the portion of each cylinder between the free floating pistons P and the closed end of the cylinder. The hydraulic pump 5A and its entirely separate hydraulic system supplies the portion of each hydraulic cylinder between the piston P and the ram 3 in said cylinder through a bore 17' in said ram.

When both pumps 5A and 5B are in operation each piston P occupies a middle position between the ram 3 and the closed end of the cylinder. Operation of the control piston 11 to the right will result in oil being pumped from cylinder 4C and 4F to 4D and 4E, the two circuits complementing each other to produce rapid movement of the rudder anti-clockwise, and movement of piston 11 to the left will have converse effect to rotate the rudder stock 1 clock-wise.

If pump 5B is switched off with the rudder at midships (FIG. 5) the solenoid operated valves $S_b$ will move upwards (see FIGS. 4A–4C) draining oil out of the spaces between the free floating pistons P and the closed cylinder ends. This will cause the pistons P to move towards the closed cylinder ends until they come into mechanical contact therewith. The drainage of oil is via restrictions 16' which are inserted in the drainage lines 16 to the oil reservoirs 100 to reduce the rate of oil flow and movement of piston P when one pump is shut off. As the pistons P move towards the cylinder ends, the space between each ram 3 and the associated piston P is increased and oil must be fed in sufficient quantity from the pump **6*a* through the feed valves 14. This sudden surge of oil flow will require a very large capacity of pump 6 and to reduce this, hydraulic accumulators 15** are fitted. These will be low pressure large capacity accumulators which will take care of sudden large demands for low pressure oil to be fed to the system.

Once the pistons P have reached the end positions where they are in contact with the closed ends of the cylinders they will stay in that position and operation of the steering gear will be by oil flow from pump 5A to the portion of each hydraulic cylinder adjacent to the ram 3 therein.

Figure 6:
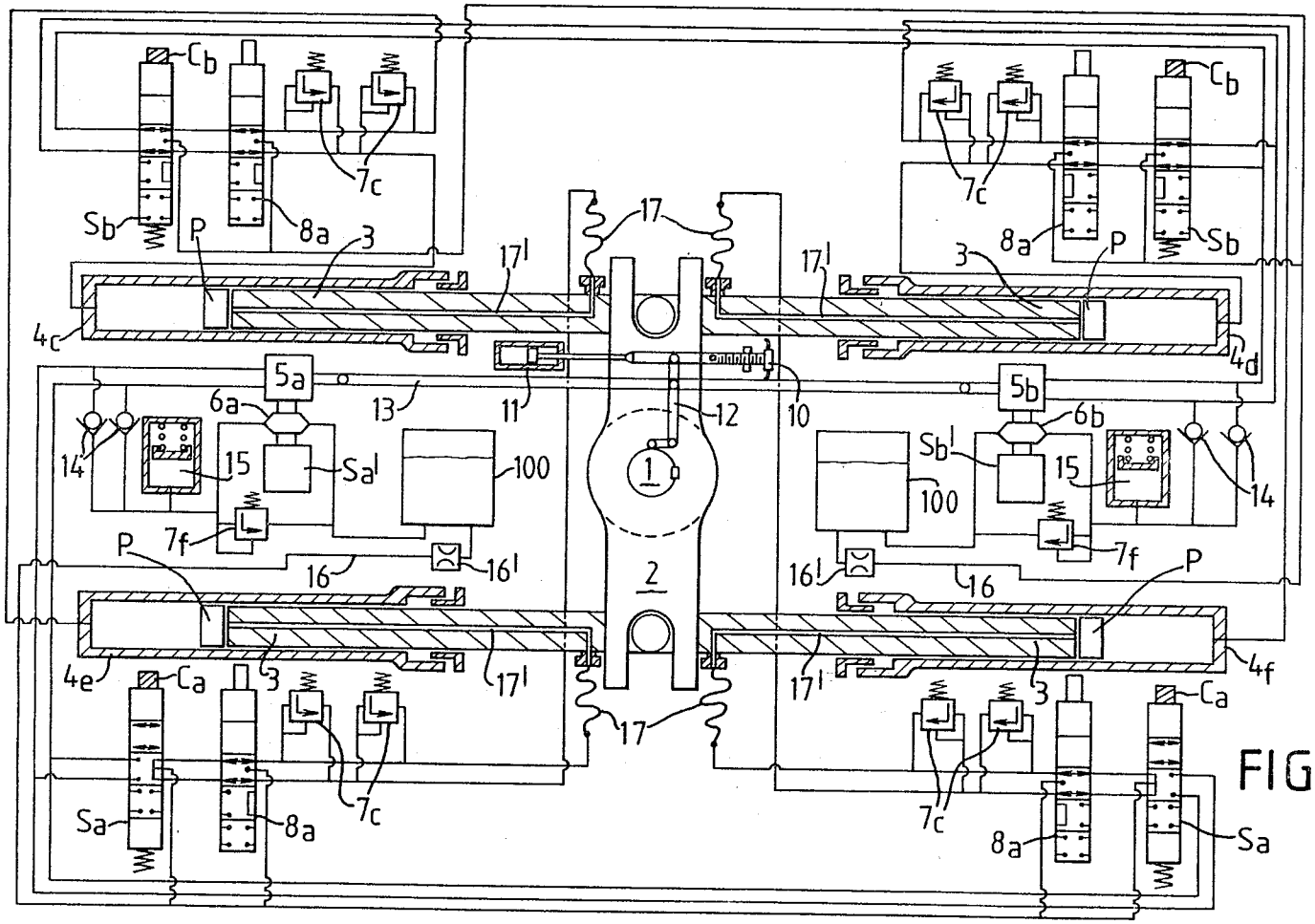

Conversely, if pump 5A is shut off the free floating pistons P come to rest against the rams 3 and operation of the main pistons 3 is by pump 5B filling the space between each cylinder end cover and the associated free piston P as illustrated in FIG. 6.

The construction of each solenoid valve S is shown in FIG. 4.

The main solenoid coils $C_a$ or $C_b$ are connected to the same electric source as the running pump 5. That is coils $C_a$ controlling valves $S_a$ are connected to pump $5_a$. Blocking coils B are connected to the electrical supply for both pumps $5_a$ and $5_b$. These coils are actuated whenever one of these pumps is running or when both pumps are running.

Figure 4C:
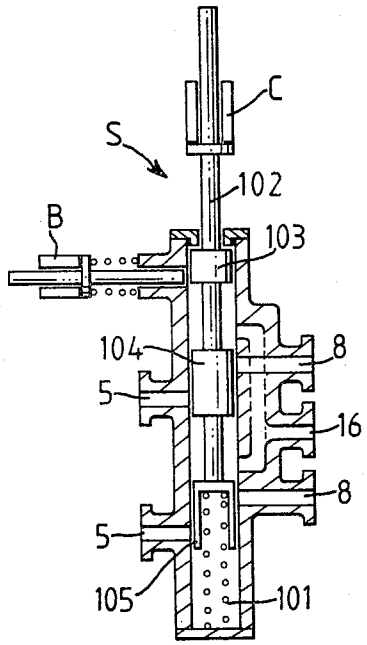
Figure 4B:
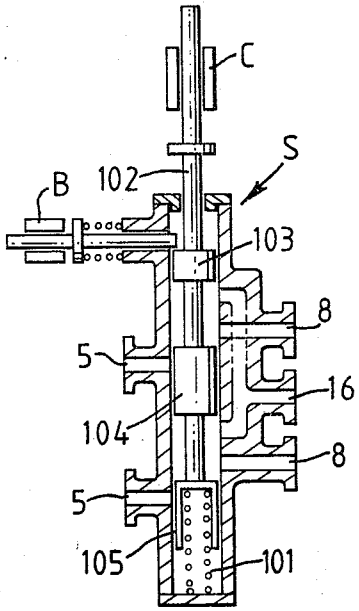
Figure 4A:
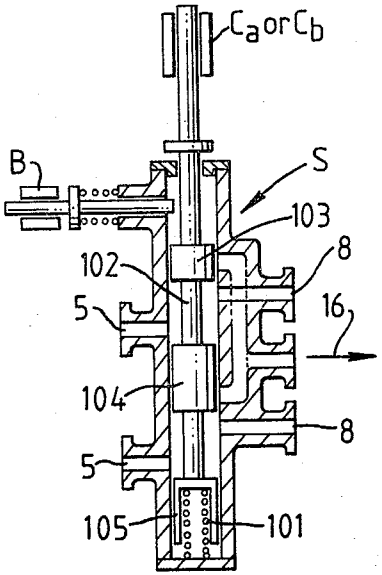
Figure 5:
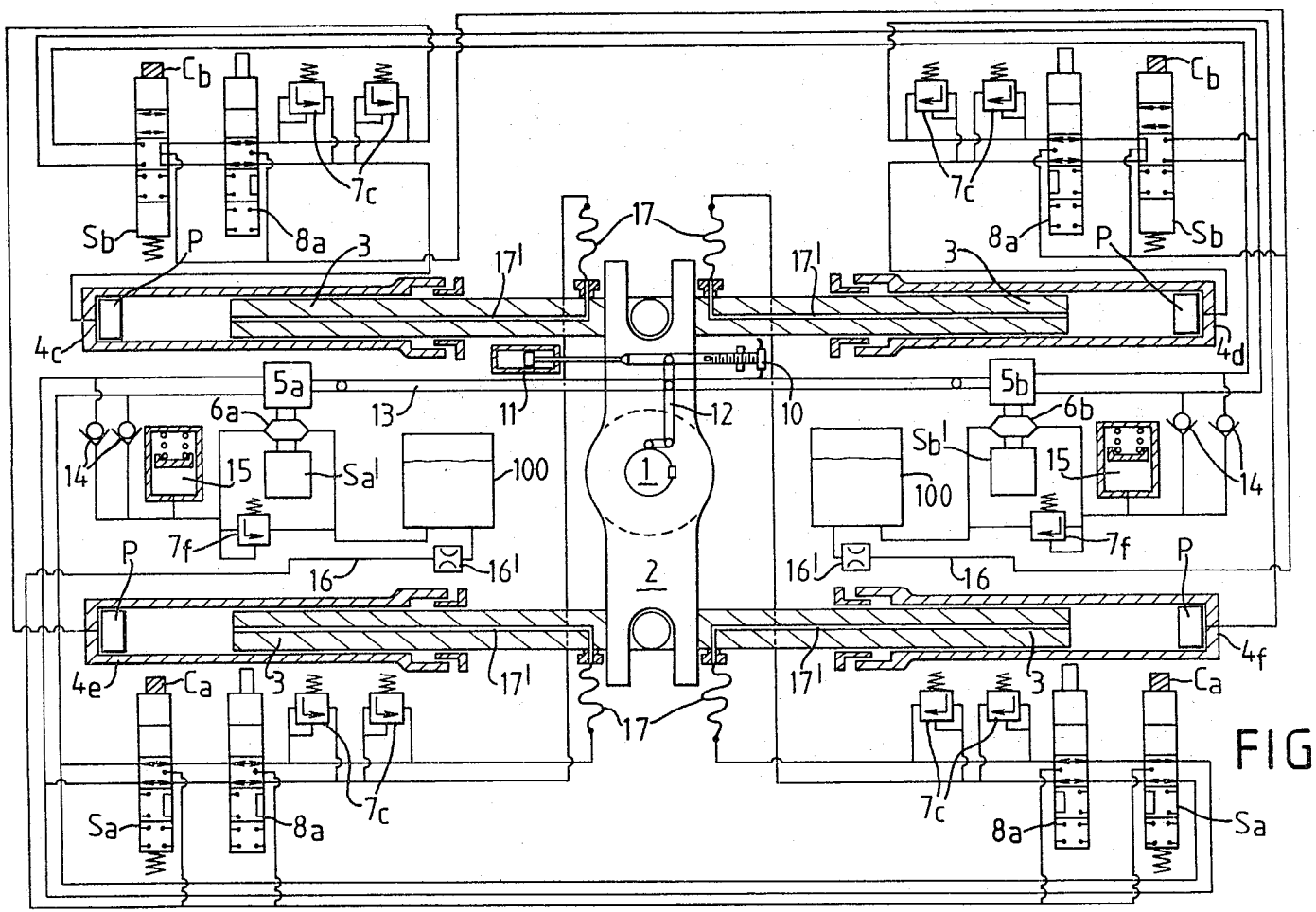
FIG. 5, FIG. 6 and FIG. 7 are views similar to FIG. 2 of the steering gear of FIG. 2 under different operational conditions, and FIG. 8 diagrammatically illustrates the application of the invention to a steering gear of a rotary vane type.

Operation is as follows:

Referring first to FIGS. 5, 4A and 4B, it is assumed that pump $5_a$ is running and pump $5_b$ is stopped. Coils $C_b$ of valves $S_b$ are not actuated and each valve $S_b$ moves upwards under the influence of the compression spring 101 but is prevented from moving to the end of its stroke by blocking spindle and coil B which is still energised. Therefore each valve $S_b$ assumes the position shown in FIG. 4B which will drain oil from the system through the lines 16.

Figure 7:
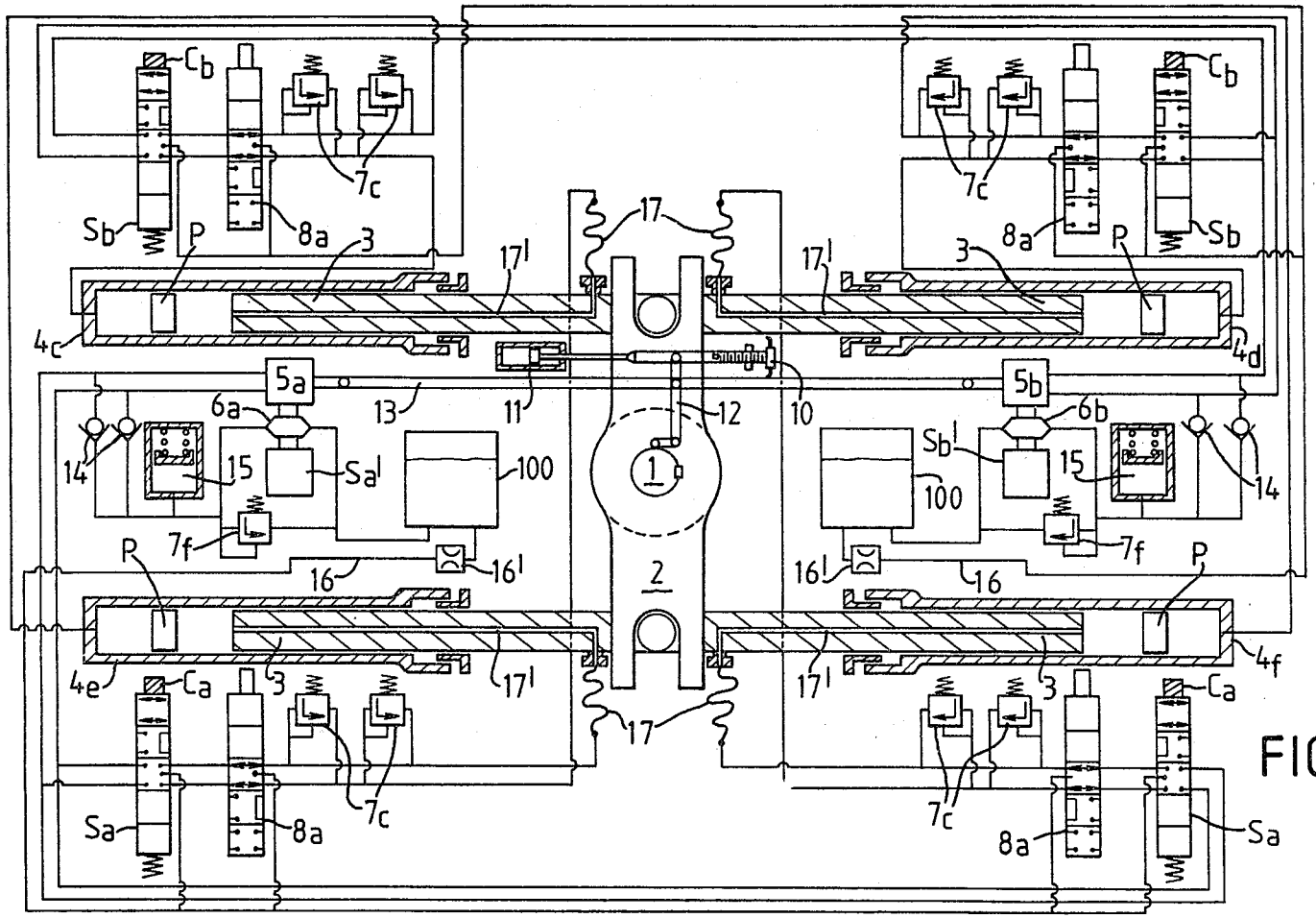

Referring now to FIGS. 7 and 4C, if both pumps should stop then all coils C of both valves $S_a$ and $S_b$ are de-energized as well as all blocking coils B. Thus each valve spindle will move to an end position in which all oil circuits are broken resulting in the rudder being held in a fixed position.

The above illustrates a means of controlling the solenoid valves S in any of three situations, (a) when both pumps $5_a$ and $5_b$ are running (FIGS. 2 and 4A), (b) one pump stopped and oil draining from its system but other pump running (FIGS. 5, 6 and 4B), or (c) both pumps stopped (FIGS. 7 and 4C). Other designs may be used which will achieve the same objective.

Figure 3:
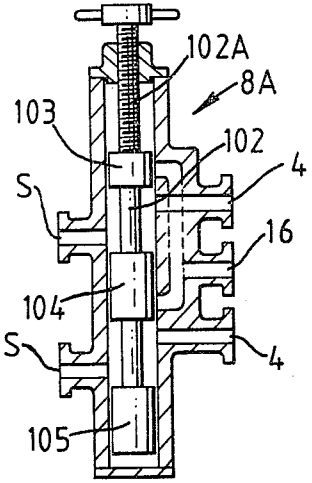
FIG. 3 is a sectional elevation on an enlarged scale of one of the manually operable isolating valves 8A used in the embodiment of FIG. 2, FIG. 4A, 4B and 4C are sectional elevations on an enlarged scale of one of the solenoid-operated valves S used in the embodiment of FIG. 2, showing the same valve in three different operative positions.

FIG. 3 illustrates one of the four manually operable by-pass and isolating valves 8A incorporated in the system of FIG. 2, one between each solenoid-operated valve S and the cylinder portions to which it supplies oil. The construction of each valve 8A resembles that of the solenoid valve S with which it is associated except that the valve stem 102 with three spaced lands 103, 104, 105, is displaceable between its three operative positions by hand turning the threaded stem portion 102A rather than by a solenoid C acting against a spring 101. The provision of the manual valves 8A permits an individual solenoid valve S to be over-ridden, for example in the event of failure, and manual closure of the entire hydraulic system by movement of every manual valve 8A to the fully raised position.

It may thus be seen that the system of FIG. 2 has, inter alia, the following features distinguishing it from the system currently in use and illustrated in FIG. 1:

(1) The hydraulic cylinders 4 are divided into two distinct and separate pressure chambers by the free floating pistons P.

(2) With both hydraulic pumps 5A and 5B in operation the free floating pistons P will lie at a mid position between the rams 3 and the closed ends of the cylinders. Oil flow of both pumps from two cylinders to diametrically opposite cylinders will result in angular movement of the rudder. With two pumps on, the oil flow from and to the two pumps will complement each other producing rapid movement of the rudder.

(3) Any one pump 5A or 5B may be shut off under open sea conditions or if failure of one system occurs. When this happens the free floating pistons P will occupy a position against the cylinder ends or against the rams 3 depending on which pump is off. The speed of angular movement of the rudder is dependent on the rate of flow through one pump only and is half that when two pumps are in use, (see FIGS. 5 and 6).

(4) The torque produced on the rudder is dependent only on the difference in hydraulic pressure between two opposite pairs of cylinders and is not altered or reduced by shutting off one pump.

(5) Complete failure of any one pressurised hydraulic fluid supply line will not reduce the available rudder torque in any way and the other separate system will continue to function.

A possible disadvantage of the system illustrated in FIG. 2 lies in the fact that normal operation is temporarily disrupted during transient conditions when the two hydraulic pumps are being started, switched off or changed over. Operational sequences that will occur on board a ship to offset this disadvantage are described below together with descriptions of changes during transient conditions.

(A) Leaving port—Start up both pumps 5A and 5B one after another. Work rudder hard over to port and then hard over to starboard. This will centre the free pistons P and operation will continue as above described.

(B) On reaching the open sea after dropping the harbour pilot, with rudder at midships, switch off one pump, either 5A or 5B. No rudder movement should normally be made during the few seconds that it will take for the free pistons P to reach their end positions. Should a movement be necessary the differential pressure caused by hydraulic pump 5A or 5B will assist to move the free pistons P over faster but no rudder movement will result until the pistons P have reached their end positions.

(C) On arrival at a port from the open sea, with initially one pump 5A or 5B in use, switch on the other pump and put the rudder hard over to each side port and starboard, after which the pistons P will attain their mid position and normal conditions will prevail.

If movement of the rudder is necessary after starting the second pump, but before manoeuvring the rudder to centre the free pistons P, the necessary excess oil will be obtained temporarily from the hydraulic accumulators 15 and pumps 6.

At sea with one pump in use it can easily be arranged that failure or stoppage or this pump 5 will cause the other pump to start automatically.

(D) To meet such a situation, the capacity of each hydraulic accumulator should be made equal to or slightly larger than the total displacement volume of two rams 3. A margin of safety in excess of this required capacity will be provided by the oil feed pumps 6.

If the main defect of the system lies in the temporary disruption of rudder movement which will occur during operation (B) when both pumps 5 were initially running and one pump is switched off, and operation (D) when failure of one pump and start up of the other pump occur, it should be noted that of these, operation (B) will not present a real problem in practice. Shut down of one pump 5 after leaving a port may be done selectively under safe conditions with adequate sea room. Abnormal change over of pumps 5 in operation (D) will only occur in case of emergency and under such conditions unavoidable temporary disruption is considered allowable, such as when electric power failure occurs and emergency generators are started up.

Regardless of the above-mentioned defect the invention will result in less chance of complete failure of steering power in ships.

Figure 8:
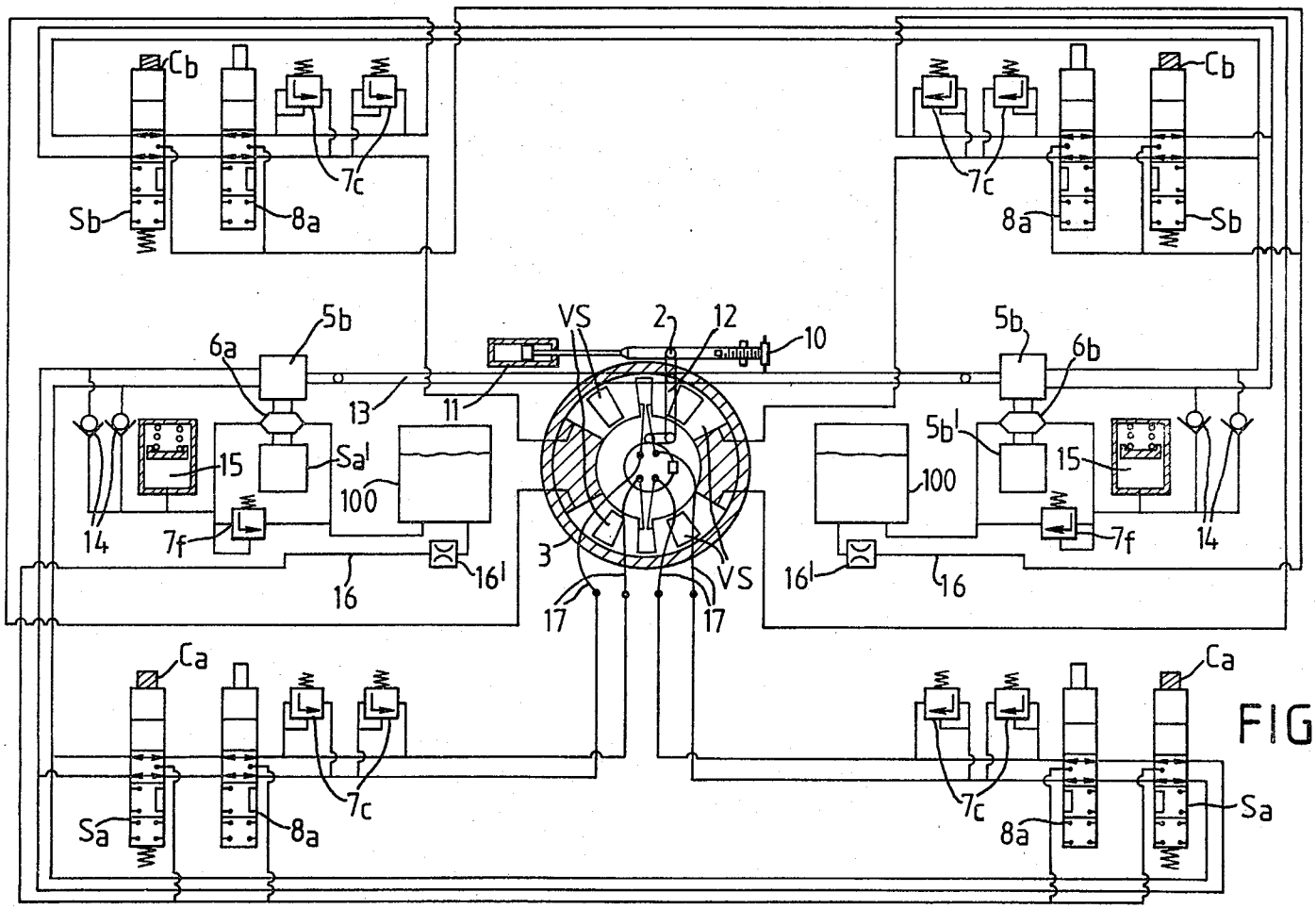

The above description relates to hydraulic ram operated steering gear for ships, but the invention may equally be applied to other types of hydraulic steering gear. FIG. 8 shows the adoption of the same principle in a "vane" type hydraulic steering gear. Here the tiller arm 2 and rams 3 in the ram type system of FIG. 2 correspond to radial rotor arms 2 which are fixed to the rudder stock 1. The segments between the arms 2 and the fixed casing 3 serve as arcuate hydraulic chambers in the same way as the cylinders 4 of the ram type system. Instead of free pistons P free floating vanes VS are arranged to separate each of the hydraulic quadrant chambers into two compartments. The working principles of this system are the same as for the hydraulic ram piston type.

With two pumps 5 running the free floating vanes VS will occupy a middle position between the rotor arms 2 and the edges of casing 3 serving as stators as shown in FIG. 8. With one pump 5 shut off the vanes VS will occupy positions adjacent to the rotor arms 2 or to the edges of casing 3.

Although only hydraulic systems have been described by way of example it will be apparent that the invention is equally applicable to a system incorporating pneumatic actuators.

I claim:

1. In a pressurised-fluid operated steering gear system for a ship comprising four pressurised-fluid actuators disposed in opposed pairs to control a common tiller arm, two pumps adapted selectively to supply pressurised fluid to actuators which are diametrically opposite across the rotary axis of the tiller arm while fluid is vented from the other two actuators, each said actuator comprising a chamber and means defining opposite end walls of the chamber relatively movable in response to variations of fluid pressure in the chamber and two supply lines opening into each chamber in spaced relation therealong between said end wall defining means and respectively connected to the pumps, the modification which comprises inserting in each chamber between the end wall defining means thereof an element forming a barrier between said supply line openings of the chamber which barrier element is movable in the chamber to close one or the other of said supply line openings in response to a pressure difference across said barrier element and the barrier elements collectively serving to isolate the pumps from one another so that failure of one pump or the pressurised-fluid circuitry associated therewith will not prevent operation of the steering gear solely by the other pump.

2. A steering gear system as claimed in claim 1, wherein valves are provided which are selectively operable to control the supply lines associated with each said pump, each valve being movable between a first position communicating said supply lines with said pump, a second position isolating said supply lines from said pump and venting said supply lines and a third position closing said supply lines, there being associated with each valve a mechanism responsive to the other pump such that said mechanism permits movement of said valve to said third position thereof only when said other pump is inoperative.

3. A steering gear system as claimed in claim 2, wherein means is provided automatically to move said valve from said first to said second position thereof in response to cessation of the pump associated with said valve and from said second to said third position thereof in response to cessation of said other pump.

4. A steering gear system as claimed in claim 1, wherein each pressurised fluid supply line is in communication with a reservoir for pressurised fluid adapted to provide the required supplement to the volume of fluid in the said other fluid supply line when said barrier element moves to close said one supply line.

5. A steering gear system as claimed in claim 4, wherein means is provided for maintaining fluid in the reservoir under pressure.

6. A steering gear system as claimed in claim 1, wherein the pressurised fluid is hydraulic fluid.

7. A pressurised-fluid operated steering gear system for a ship comprising a tiller arm having a rotary axis, four cylinders each having a closed end and an open end, the cylinders being disposed in pairs on opposite sides of the rotary axis of the tiller arm with the open ends of the cylinders of each pair opposed to one another, two rams articulated to said tiller arm on opposite sides of said rotary axis thereof, the opposite ends of each ram entering and being movable within the open ends of a respective said pair of cylinders, two pumps having respective supply lines to each cylinder, the supply line of one pump opening to each cylinder at a position spaced therealong from the supply line opening of the other pump and a barrier element extending across and slideable along each cylinder between the closed end thereof and the ram end entering the same in response to a pressure difference across said element so as to close one or the other of said supply line openings, the arrangement being such that pressurised fluid can be introduced from one or both of the pumps into two of the cylinders which are diametrically opposite to one another across said tiller arm rotary axis while fluid is vented from the other two cylinders thereby producing an opposite longitudinal displacement of said rams which will rotate the tiller arm, said barrier elements serving to isolate the pumps from one another so that operation of the steering gear by one pump only will not be prevented by failure of the other pump or pressurised fluid circuitry associated therewith.

8. A pressurised-fluid operated steering gear system for a ship, comprising a rotary actuator for rotating a tiller, a plurality of arcuate chambers for pressurised fluid in said actuator defined between rotor vanes and stator vanes thereof, two pumps having associated supply lines which communicate each pump with each chamber, said supply lines opening to each chamber at positions arcuately spaced therealong from one another and a free vane in each chamber interposed between the rotor vane and stator vane defining the same and movable in response to a pressure difference across said free vane to a position closing one or the other of said supply line openings of the chamber, the arrangement being such that the tiller can be rotated by introducing from either or both of the pumps pressurised fluid into a pair of said chambers which are diametrically opposite across the rotary axis of the actuator while venting fluid from other chambers and such that said free vanes isolate the pumps from one another so that operation of the steering gear by one pump only will not be prevented by failure of the other pump or pressurised fluid circuitry associated therewith.

* * * * *